United States Patent [19]

Rynning

[11] 3,986,655

[45] Oct. 19, 1976

[54] PACKAGING TRAY

[75] Inventor: Eivind Prydz Rynning, Honefoss, Norway

[73] Assignee: Keyes Fibre Company, Waterville, Maine

[22] Filed: Feb. 3, 1976

[21] Appl. No.: 654,886

[52] U.S. Cl. ..... 229/2.5 R; 217/26.5

[51] Int. Cl.[2] ..... B65D 1/00; B65D 65/00

[58] Field of Search ..... 229/2.5; 217/26, 26.5

[56] References Cited

UNITED STATES PATENTS

| | | | |
|---|---|---|---|
| 2,951,605 | 9/1960 | Flynn | 217/26.5 X |
| 3,563,445 | 2/1971 | Clayton | 229/2.5 X |
| 3,682,365 | 8/1972 | Reifers et al. | 229/2.5 |
| 3,700,096 | 12/1972 | Reifers | 229/2.5 |
| 3,756,492 | 9/1973 | Reifers | 217/26 |
| 3,764,057 | 10/1973 | Reifers | 229/2.5 |
| 3,885,727 | 5/1975 | Gilley | 229/2.5 |
| 3,885,728 | 5/1975 | Gilley | 229/2.5 |

*Primary Examiner*—Davis T. Moorhead

*Attorney, Agent, or Firm*—Connolly and Hutz

[57] ABSTRACT

Packaging tray for meats and the like is molded with upstanding marginal lip and adjoining rib to provide trough around upper edge of its periphery, thus better keeping juices from leaking over tray edge when package is overwrapped. Gaps can be provided in rib to drain back juices from trough, and tray floor can have viewing windows in elevated portions to reduce juice leakage through the floor.

6 Claims, 4 Drawing Figures

Fig. 1.
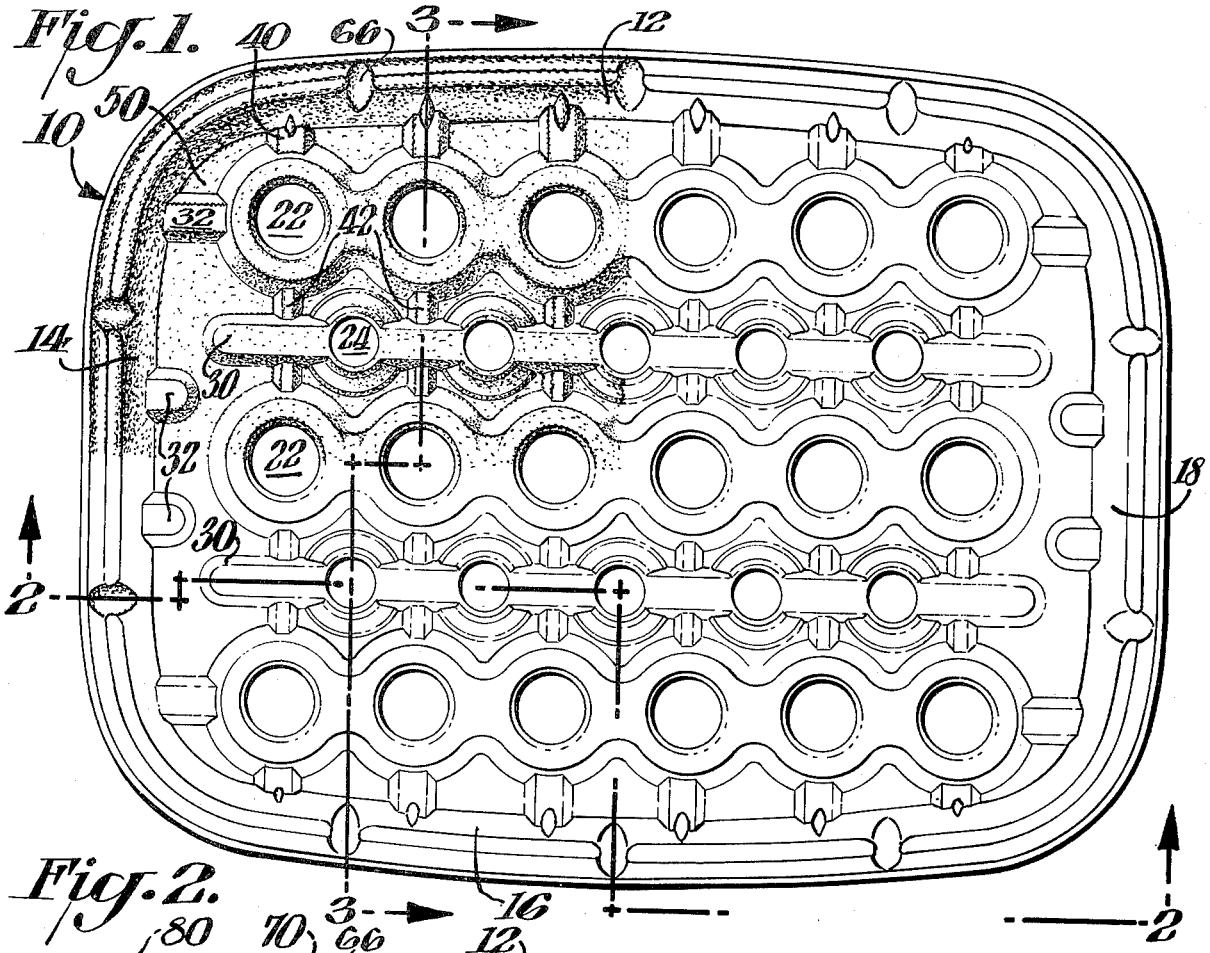
Fig. 2.
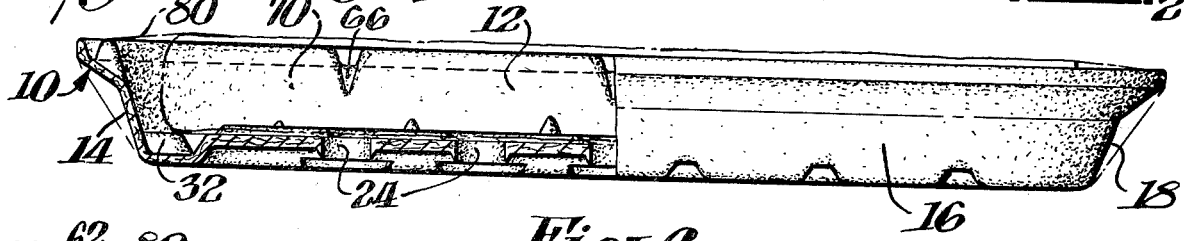
Fig. 3.
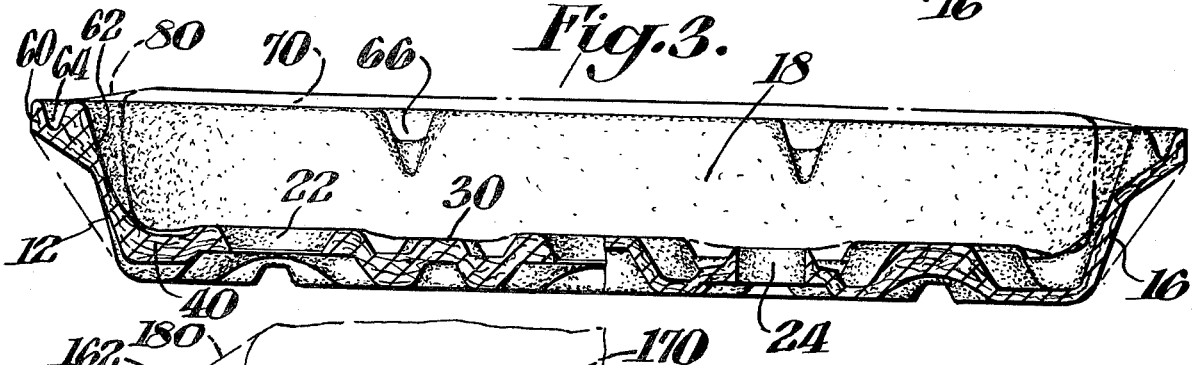
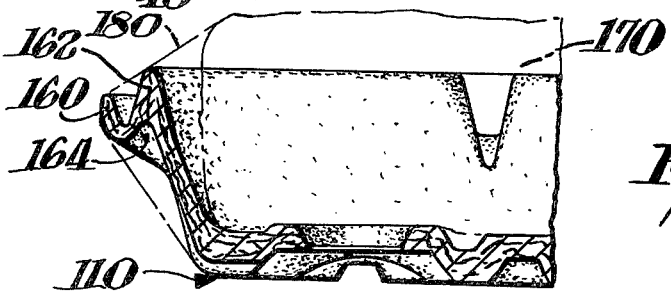
Fig. 4.

PACKAGING TRAY

The present invention relates to packaging trays such as are used in meat markets to display meats as well as other foods, for sale.

Among the objects of the present invention is the provision of novel packaging trays better adapted for such display use.

The foregoing as well as additional objects of the present invention will be more fully understood from the following description of several of its embodiments, reference being made to the accompanying drawings wherein:

FIG. 1 is a top plan view of a packaging tray pursuant to the present invention;

FIGS. 2 and 3 are sectional views along lines 2—2 and 3—3, respectively, of the tray of FIG. 1, showing a slice of meat wrapped on the tray; and FIG. 4 is a sectional detail of a modified tray typical of the present invention.

According to the present invention the side walls of packaging trays of the above type have their upper ends terminate in a generally vertical lip, and also have ribs generally paralleling the upper ends and spaced internally from those upper ends to define between the lips and the ribs a narrow trough about 1 to 3 millimeters deep, the wall lips and the tops of the ribs providing spaced engagement with the overwrap to thus better keep meat juices and the like from leaking past the walls.

The floors of the trays of the present invention are preferably provided with a large number of viewing windows through which the contents of the tray can be examined from the bottom of the tray. Such windows are desirably located in elevated portions of the tray floor, to help the juices collect at the lower levels of the floor.

The packaging trays of the present invention are particularly suited for molding from wood pulp as described in U.S. Pat. No. 3,243,096, but they can also be molded from plastic sheeting or the like. When molded from wood pulp the ribs referred to above are readily made of thickened unhollowed construction to thus help strengthen and rigidify the side walls. The lips at the upper ends of the walls can then be unreenforced and relatively yieldable in the inward direction to give slightly and thus better maintain juice-sealing contact with the overwrap along the entire periphery of the tray.

Regardless of how the ribs are constructed, it is helpful to have them interrupted about every 3 to 8 centimeters to provide drainage for any juices that find their way into the trough.

Turning now to the drawings, these illustrate trays of the present invention adapted from the tray shown in U.S. Pat. No. 3,885,727. Tray 10 of the presnt FIGS. 1, 2 and 3 has a somewhat rounded rectangular shape with side walls 12, 14, 16 and 18, and a floor 20. The floor has a large number of viewing windows 22 and 24, windows 22 being larger than windows 24. All the windows have their upper margins well elevated above adjacent portions of the floor so that juices normally oozing from meat slices placed on the tray, preferentially drain down to the low portions of the floor. To the same end the windows are not of very large size, generally circles less than 15 millimeters in diameter and spaced at least about 1 centimeter apart, so that there is ample floor surface to collect and hold a substantial amount of juices and direct oozing through the windows is quite limited. The smaller windows 24 can be made about two-thirds the width of the larger windows, to help in this connection.

Longitudinal upstanding flutings or corrugations 30,32,34, as well as transverse ones 40,42 are shown as formed in the floor to reenforce and stiffen it. Where such flutings form isolated pockets in the floor, as at 50, it is preferred to arrange for the tops of the isolating flutings to be somewhat below the upper margin of the windows. Only about 1 millimeter height difference is adequate for this purpose and will permit juices draining into one pocket to overflow into adjoining portions of the floor without dripping through the windows.

Floor 20 merges into the sidewalls which terminate in upstanding lips 60. Inboard of these lips and spaced a short distance from them, are ribs or baffles 62 shown of thickened, unhollowed construction. Between the lips 60 and ribs 62, there is a trough 64 about 2 millimeters deep and about the same in width. About every five centimeters along the ribs, they are interrupted by notches 66 which permit drainage of juices from the trough down to the floor.

The wrapping of a cut of fresh meat on tray 10, is represented in FIGS. 2 and 3 where the meat is shown at 70 and a transparent overwrap film at 80. The film is generally a stretchy polyvinyl chloride formulation that is stretched fairly taut around the tray and meat, and folded together under the tray where the folds can be heat sealed to lock the film in place. Such packages placed on display at a meat market for example, often present unattractive appearance because bloody juices exuded by the wrappd meat find their way into the folds of film under the tray where they are trapped as an unsightly discoloration. Also when the package is eventually opened the juices so trapped spill or are splashed out and can make messes.

Tray 10 does a very good job of minimizing juice leakage. Nearly all of the juices simply drain onto the floor 20 where they remain and can be at least partly soaked up where the tray is molded from wood or paper pulp. Handling of the packaged tray, as by a customer for the purpose of inspecting the packaged meat, will tilt it and cause juice on the floor to run down the tilted tray to the rib 62 in the low portion of the tray. There the juice is barred against further downhill movement except at notches 66. At those notches the juice can then run into the adjacent portion of trough 64. Returning the tray to its normal level upright position as in FIGS. 2 and 3, permits juice thus collected in the trough to promptly run back down to the floor through the notches 66.

Some juice can even find its way over the tops of ribs 62 when the tray is tilted, as for example where there is a wrinkle or loose region in the overlying film, or an irregularity in the rib. Such juices will also be free to flow down the trough and notches back to the floor, when the tray is again righted.

The trough also collects juices flowing downwardly in a tilted tray, so that there is less tendency for them to climb over the top of lip 60. The lip is not reenforced so that it is quite yieldable in response to inwardly directed forces, and will accordingly be flexed by the overwrap film to a degree that varies with the tension in the film. Very good liquid-tight sealing is thus provided even where there is some irregularity in the lip or severe variations in the film tension.

As a result film-wrapped packages of the trays of the present invention are better at confining juices to the tray floor than such packages of the trays of U.S. Pat. No. 3,885,727. This is so even though the side edges of the patented trays provide a double seal against an overlap film as shown in FIG. 4 of that patent. One seal of the double seal is at the upper edge of a marginal ridge, and the other seal is at the outer edge of a horizontal marginal flange. Any juice finding its way over the ridge remains trapped in the space above the horizontal flange where, even when the tray is horizontal it can flow along the edge of the flange until it finds a path through which to leak over that edge.

What has been described above for juices from packaged meat also applies to the packaging of poultry parts and fish. Juices exude in each, particularly when they are packed in frozen or partly frozen condition and the frozen portions then thaw out to liberate water.

The tray 10 of FIGS. 1–3 according to the present invention is designed for the packaging of articles no higher than about the height of its side walls. Articles that are significantly higher will lift the overwrap film away from engagement with rib 62 so that the juice blocking effect of that rib is largely defeated.

FIG. 4 shows a modified edge construction for a tray 110 designed to hold thick slices of meats or the like. In this construction the marginal lip 160 has its upper edge substantially below the level of the top of rib 162, so that film 180 engages both of them when wrapped around the thick article 170.

In the construction of FIGS. 1–3, the top of lip 60 can be slightly, as for example 1 millimeter, below the top of rib 62. Even when both tops are at the same level in the unwrapped tray, a little inward flexing of lip 60 under the influence of the tension in the overwrap brings the top of the lip down a little as it flexes inwardly.

Ribs 162 are larger than ribs 62 and are shown as partly hollowed at the lowest portion 164 of their interior. Ribs 62 can be correspondingly or even completely hollowed, although this is not as desirable inasmuch as it significantly reduces the rib stiffness and the strength of the tray.

Conversely some or all the flutes in the tray bottom can be made in the form of thickened, unhollowed ridges. This is particularly suitable for the shallow flutes 42.

When the trays of the present invention are molded from plastic sheeting it is generally preferred to have the ribs and flutes all hollow so that all parts of the tray have the same wall thickness, such as 0.15 millimeters.

Molded pulp trays of the present invention can have wall thickness of about 1.5 to 2 millimeters and can be heavily sized, particularly on their inside surfaces, so that they do not soak up much liquid and thus are not weakened by such a soaking. The soaking up is not needed to keep the juices from leaking out. The overall lengths and widths of such trays can vary from about 10 centimeters by 15 centimeters to about double those dimensions.

Obviously many modifications and variations of the present invention are possible in the light of the above teachings. It is, therefore, to be understood that within the scope of the appended claims the invention may be practiced otherwise than as specifically described.

What is claimed is:

1. In a molded tray for the display packaging of fresh meat and the like in conjunction with a transparent overwrap film, the improvement according to which the side walls of the tray have their upper ends terminate in a generally vertical lip, and also have ribs generally paralleling the upper ends and spaced internally from those upper ends to define between the lips and the ribs a narrow trough about 1 to 3 millimeters deep, the wall lips and the tops of the ribs providing spaced engagement with the overwrap to thus better keep meat juices and the like from leaking past the walls.

2. The combination of claim 1 in which the floor of the tray has a large number of viewing windows through which the contents of the tray can be examined from the bottom of the tray.

3. The combinaton of claim 2 in which the viewing windows are in elevated portions of the tray floor to help juices collect at the lower levels of the floor.

4. The combination of claim 1 in which the tray is a molded pulp tray and the ribs are thickened unhollowed members that stiffen the walls.

5. The combination of claim 1 in which the ribs have short interruptions about 3 to about 8 centimeters apart to permit drainage of any juices that find their way into the trough.

6. The combination of claim 4 in which the lips at the upper ends of the side walls are unreenforced and relatively yieldable in the inward direction.

* * * * *